US006880965B1

(12) United States Patent
Sheffield, Jr.

(10) Patent No.: US 6,880,965 B1
(45) Date of Patent: Apr. 19, 2005

(54) GATE FOR MIXER UNIT OF A CONCRETE TRANSPORT VEHICLE

(76) Inventor: Robert W. Sheffield, Jr., 165 New St., Hoschton, GA (US) 30548

( * ) Notice: Subject to any disclaimer, the term of this patent is extended or adjusted under 35 U.S.C. 154(b) by 157 days.

(21) Appl. No.: 10/342,041

(22) Filed: Jan. 14, 2003

Related U.S. Application Data

(60) Provisional application No. 60/348,596, filed on Jan. 15, 2002.

(51) Int. Cl.[7] ..... B28C 7/00

(52) U.S. Cl. ..... 366/41; 366/347

(58) Field of Search ..... 366/41, 42, 45, 366/62, 63, 68, 53, 54, 185, 192, 347

(56) References Cited

U.S. PATENT DOCUMENTS

| | | | | | |
|---|---|---|---|---|---|
| 1,259,769 | A | | 3/1918 | Olsen | |
| 1,456,877 | A | * | 5/1923 | Kennedy | 366/42 |
| 2,063,574 | A | | 12/1936 | Yett | 83/73 |
| 2,477,568 | A | | 8/1949 | Beckwith | 366/29 |
| 2,544,085 | A | * | 3/1951 | Hilkemeier | 366/41 |
| 2,544,545 | A | * | 3/1951 | Rockburg | 366/41 |
| 2,563,963 | A | * | 8/1951 | Rockburg | 366/41 |
| 2,574,184 | A | * | 11/1951 | Jaeger | 366/41 |
| 2,578,170 | A | * | 12/1951 | Bohmer | 366/41 |
| 2,589,492 | A | * | 3/1952 | Graham | 366/41 |
| 3,231,146 | A | * | 1/1966 | Troy | 366/42 |
| 3,635,449 | A | | 1/1972 | Johnson | 366/66 |
| 4,016,978 | A | | 4/1977 | Danna, Jr. | 209/2 |
| 4,154,534 | A | | 5/1979 | Lawrence et al. | 366/42 |
| 4,428,677 | A | | 1/1984 | Schreiter, Jr. | 366/41 |
| 4,441,820 | A | | 4/1984 | Maxon, III | 366/26 |
| 4,865,457 | A | | 9/1989 | Strehlow | 366/18 |
| 4,951,260 | A | | 8/1990 | Strehlow | 366/45 |
| 4,963,032 | A | | 10/1990 | Strehlow | 366/57 |
| 6,126,307 | A | | 10/2000 | Black et al. | 366/43 |
| RE37,018 | E | | 1/2001 | Cronquist | 366/68 |

OTHER PUBLICATIONS

Affidavit of Robert W. Sheffield, Jr., executed Jun. 6, 2003.
Affidavit of Joseph Click, executed Jun. 6, 2003.
Affidavit of David McCollum, executed Jun. 30, 2003.

* cited by examiner

*Primary Examiner*—Tony G. Soohoo
(74) *Attorney, Agent, or Firm*—Womble Carlyle Sandridge & Rice, PLLC

(57) ABSTRACT

A mixing drum gate for a concrete transport vehicle is described. The gate includes a pivotally mounted plate that abuts the lower portion of the rim of the drum mouth and is biased against it so as to maintain the abutment during rotation, shifting and flexing of the drum. The gate may include a pneumatically controlled opening mechanism that pivots the plate between an open, closed and intermediate positions.

26 Claims, 5 Drawing Sheets

GATE FOR MIXER UNIT OF A CONCRETE TRANSPORT VEHICLE

CROSS-REFERENCE TO RELATED APPLICATIONS

This application claims the benefit of provisional application Ser. No. 60/348,596, dated Jan. 15, 2002.

TECHNICAL FIELD

The present invention relates generally to concrete mixing vehicles and apparatus to be used therewith. More particularly, the invention relates to apparatus used to reduce the incidence of inadvertent discharge of material from the mixing drum of a concrete mixing vehicle.

BACKGROUND

Generally, a concrete transport vehicle has a mixer unit that includes a rotatable mixing drum in which concrete can be mixed and transported. Concrete is usually loaded and unloaded through the drum mouth, which is angled upwards along an inclined axis. The typical concrete truck also includes a hopper for feeding concrete into the drum and a chute for channeling concrete out of the drum. The hopper and chute are normally aligned adjacent the mouth of the drum with the chute positioned below the hopper. As the concrete transport vehicle moves, the mixer unit tends to flex and shift. When combined with the constant rotation of the drum, this flexing and shifting provides for rather irregular positioning of the drum mouth. When the mixer unit contains concrete, it is not uncommon for some concrete material to be inadvertently discharged from the drum mouth, especially when the concrete truck is moving especially up hill. Consequently, concrete may fall from the mixing unit onto roadways and construction sites, resulting in a loss of valuable concrete as well as the potential for a safety hazard or at least a nuisance. Even in light of the potential consequences of inadvertent discharge, little past progress has been made to reduce effectively the likelihood of such discharge due to the irregularity of the movement of the mixing drum. Consequently, there is a need for an apparatus that helps to reduce the occurrence of inadvertent discharge of concrete material from the drum mouth of a mixing unit, as well as a concrete transport vehicle that incorporates the principles of such a device.

SUMMARY

An apparatus for reducing the likelihood of an inadvertent discharge of concrete material from the drum mouth of a concrete mixing unit is disclosed. The present invention encompasses a gate that, when closed, obstructs at least a portion of the drum mouth so as to reduce the chance that concrete material inadvertently falls from the mixing drum, even when the drum is rotating and the vehicle is moving. The gate generally includes a plate mounted adjacent to the mouth of the mixing drum and movable between an open position and a closed position. When the plate is in the closed position, it is biased against the rim of the mouth of the mixing drum by a biasing member and generally maintains contact with the rim even as the mixing drum rotates and the vehicle moves.

One embodiment includes a gate with a plate hingedly mounted on the concrete truck adjacent the mouth of the drum. The hinge may include one or more pivot pins connected to the plate and pivotally mounted to brackets. The brackets may include biasing members, such as springs, that bias the plate toward the mixing drum, so that the plate maintains closed contact with the rim of the mouth of the drum, even when the drum is rotating and/or the vehicle is moving. An opening mechanism may also be operably connected to the plate. The opening mechanism can adjustably reposition the plate between an open position, a closed position or some intermediate position therebetween. The opening mechanism may be designed to be operated from within the cab of the vehicle or by an operator standing next to the vehicle.

Another embodiment encompassing principles of the present invention includes a gate having a generally semicircular plate with two pivot pins axially aligned and extending from the from the top portion of the plate. Each pin is pivotably connected to a bearing that is moveably mounted to a bracket. Each bracket includes an elongated track in which a shoe extending from the bearing is disposed. The shoe of each bearing cooperates with a spring disposed within the tract, whereby the spring biases the shoe, and, in turn, the bearing, pivot pin and plate toward the mixing drum, while also allowing these components to move with the mixing drum as it flexes. Each mounting bracket is secured on the mixing truck in a convenient location, such as, for example, on the hopper support mount. The opening mechanism may include a pneumatically-controlled cylinder connected to the gate by a moveable arm or piston. The arm or piston is connected to the plate and the cylinder is mounted to the outside of the hopper of the mixing vehicle. The pneumatic controls may be wired into the cab of the truck to the facilitate ease of operation of the gate.

In use, the gate may be adjustably positioned so that the plate contacts at least a lower portion of the rim of the mouth of the mixing drum or is otherwise disposed adjacent the drum mouth to prevent concrete materials from falling away from the drum. Even with the plate in contact with a portion of the drum mouth, the mixing drum can still be rotated in order to prevent setting of the concrete contained therein. Contact between the plate and rim of the drum mouth generally is maintained even as the drum rotates, flexes and shifts. This contact is maintained by the biasing force applied either directly or indirectly to the plate. The biasing force may be generated by springs located in the channels of the mounting brackets or other appropriate devices and arrangements. In this manner, the mouth of the mixing drum is at least partially obstructed so as to reduce the likelihood of inadvertent discharge of concrete materials from therein. As the concrete truck is operated, contact is maintained between the plate and the rim of the mouth until such time as it is desired to either charge or discharge the aggregate contained within the mixing drum. At such time, the gate may be adjustably opened. If the gate includes an opening mechanism, such as the above pneumatic arrangement, then the opening mechanism may be activated to adjustably move the gate to an open, closed or intermediate position.

Thus, a mixing drum gate is now provided that successfully addresses the problems and shortcomings of the prior art. The mixing drum gate allows concrete materials to be maintained inside the mixing drum of a concrete truck as the mixing drum is rotated and the truck is operated, while reducing the likelihood of inadvertent discharge of these materials. This mixing drum gate also may be repositioned easily to allow efficient and normal charging and discharging of the concrete materials from the mixing drum. These and other aspects of the mixing drum gate of this invention will become more apparent upon review of the detailed description set forth below when taken in conjunction with the accompanying drawings, which are briefly described as follows.

DETAILED DESCRIPTION

Figure 1:
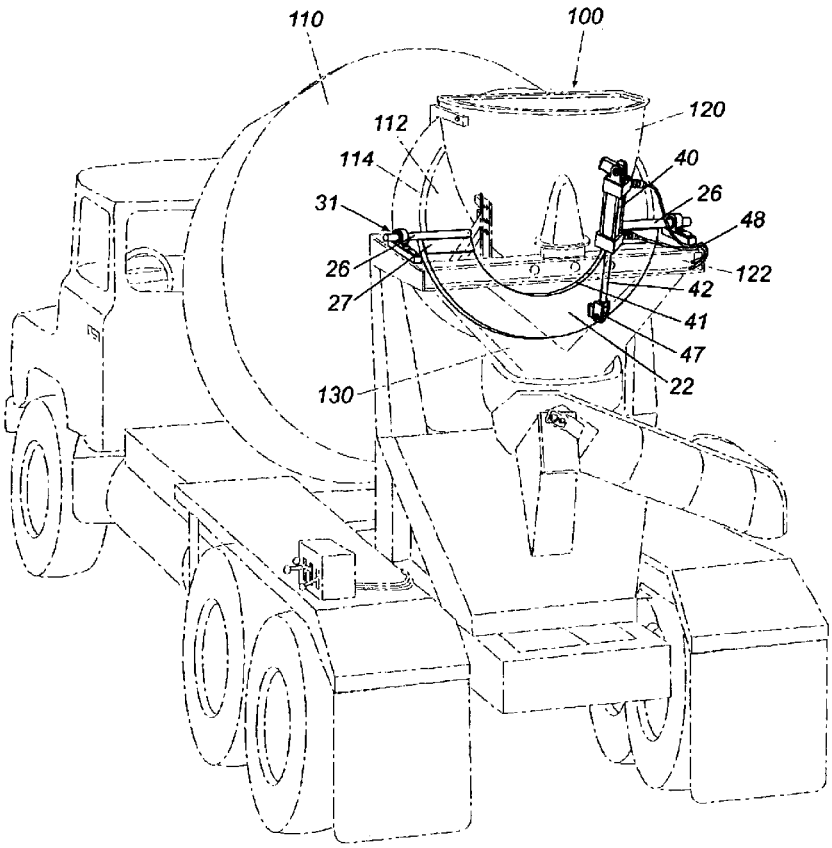
FIG. 1 is a perspective rear view of a concrete mixing transport vehicle with a mixing drum gate that encompasses principles of the present invention and with portions of the vehicle shown in phantom line.

Referring now in more detail to the drawings, FIGS. 1–8, in which like numerals refer here appropriate to like parts throughout the several views, FIG. 1 is a perspective view of the ear of a concrete transport vehicle or concrete truck 100. The truck 100 is shown in phantom line so as to highlight the mixing drum gate 20, which would otherwise be partially obstructed by the hopper/chute assembly mounted at the rear of the mixing drum 110. The concrete truck 100 generally includes a mixing drum 110 with a mouth 12 formed therein, which is defined by a rim 114. Adjacent to the mouth 112 of the mixing drum 110 is located a hopper 120, which is used to charge the mixing drum 110 with concrete material from overhead. Also, adjacent the mouth 112 of the mixing drum 110 is a chute 130, which generally is positioned below the hopper 10 and provides a conduit through which concrete material may be discharged from the mixing drum 110. A hopper support brace 122 is attached to the concrete truck 100 and is aligned so as to support both the hopper 120 and the chute 130. The mixing drum gate 20 is disposed adjacent the mouth 112 of the mixing drum 120, and is shown in FIG. 1 in a closed position. While this particular example has the drum mouth positioned at the rear of the vehicle the present invention applies equally to mixing units and vehicles that are forward or side loading. Since the size and orientation of drum mouths of concrete trucks vary from vehicle to vehicle, the mixing drum gate may vary in dimension and positioning to operate properly with a given vehicle.

Figure 2:
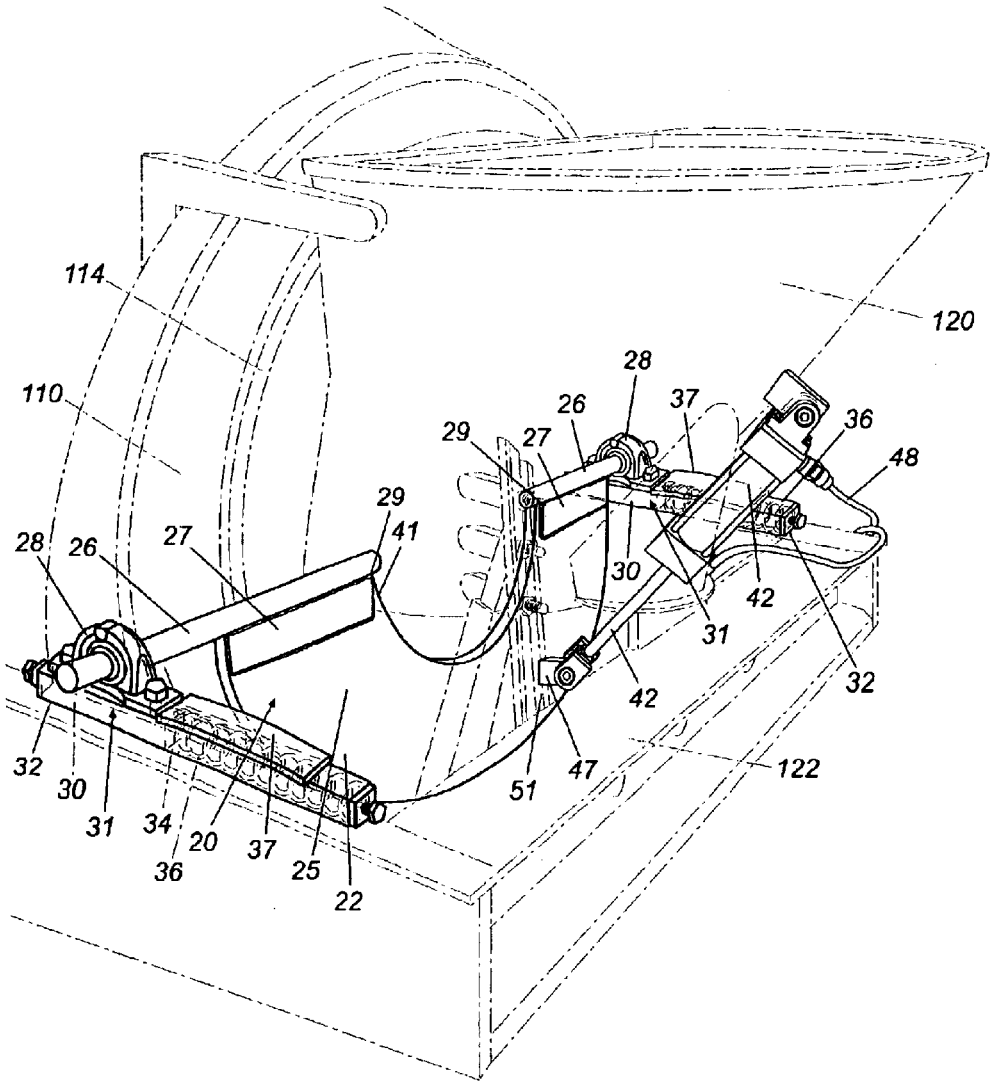
FIG. 2 is another perspective view of the vehicle with a mixing drum gate of FIG. 1 with portions of the vehicle shown in phantom line.
Figure 8:
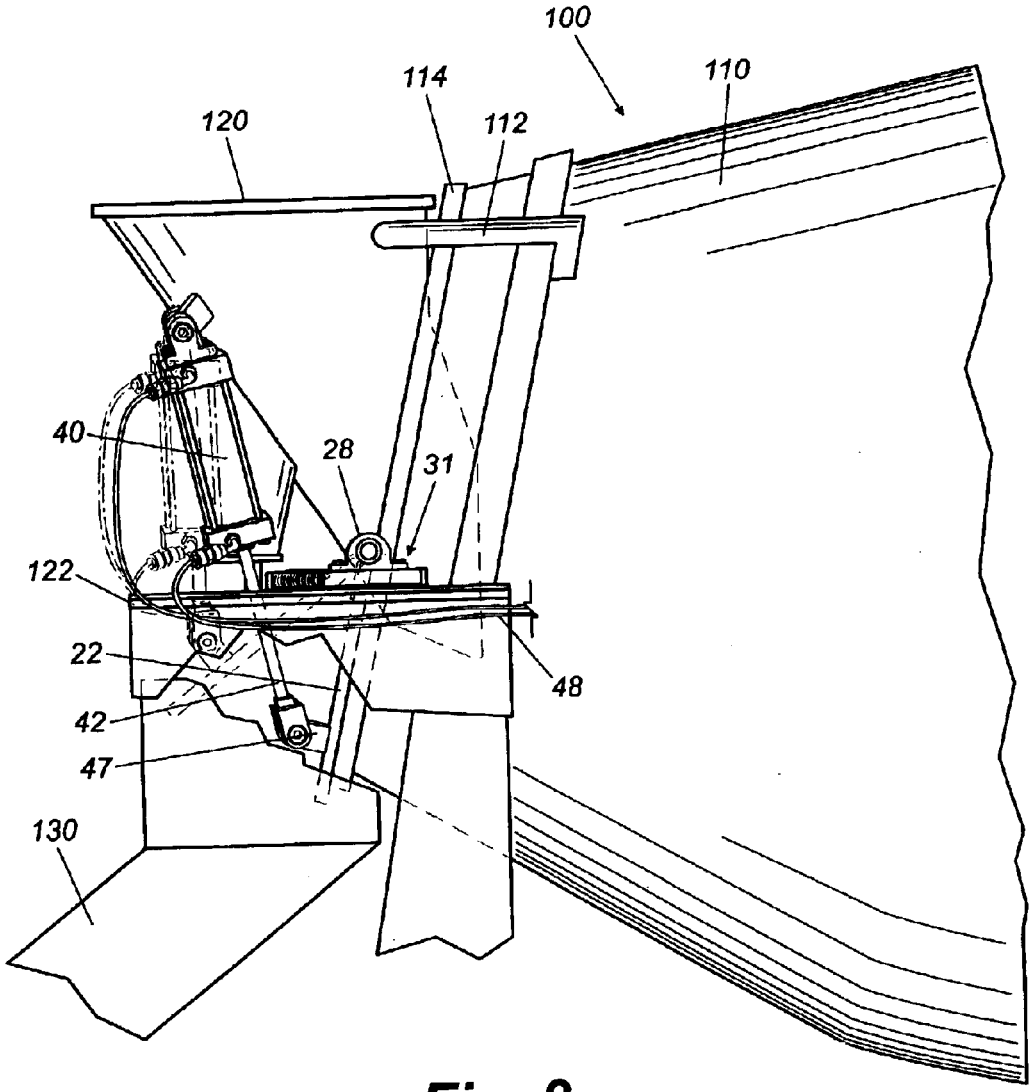
FIG. 8 is a side view of the mixing drum gate of FIG. 1 in a closed position and also in phantom line in an open position.

In general terms, the embodiment of the mixing drum gate 20, shown in FIGS. 1, 2 and 8, includes a plate 22 attached to pivot pins 26 that are pivotally connected to a bracket assembly 31 mounted on the concrete truck 100. Each bracket assembly 31 biases the pivot pin 26 and the plate 22 toward the mixing drum 110 so that the plate 22 contacts the rim 114 of the mouth 112 of the drum 110. The plate 22 is pivotally opened and closed by an opening mechanism including a pneumatically controlled cylinder 40 that is connected either to a pivot pin 26, plate or other convenient connection to actuate the pivoting movement of the plate 22.

In more particular terms, the mixing drum gate 20 includes a plate 22 formed of steel or another appropriate durable material. The plate 22 generally is shaped in a semi-circular form so as to cover the lower portion of the mouth 112 of the mixing drum 110, although other appropriate shapes for obstructing the mouth of the mixing drum are contemplated by the present invention. The plate 22 is pivotally mounted so that it may swing back and forth from an open position to a closed position. Along its topside, the plate 22 includes shoulders 29 that extend radially from a notch 41. The notch 41 is generally semi-circular and is provided to allow clearance of the lower portion of the hopper 120 as the plate 22 is opened and closed. The plate also has lips 27 extending from the outer face 25 of the plate 22. As shown in FIG. 2, the lip extends beyond the top edge of the plate 22 and is attached, such as by welding, to a pivot pin 26.

The pivot pins 26 are connected to the lips 27 by welding or other appropriate connection. Each pivot pin 26 is slightly offset from the topside of the plate 22 by approximately the width of the lip 27. The lip 27 may be formed of a metal bar or other appropriate structure to form generally about a 90 degree angle with the plate 22. The pivot pins 26 generally extend radially from the top center of the plate 22 and are axially aligned with each other. Each pivot pin 26 is journaled within a bearing 28 that is axially aligned with the pin 26. The cooperation between each bearing 28 and each pivot pin 36 connected thereto allows the plate 22 to be pivotally adjusted between open, closed and intermediate positions. As shown in FIG. 8, plate 22 may be pivotally adjusted downward to a closed position and upward to an open position.

Each bearing 28 forms a portion of a bracket assembly 31, which, in one embodiment includes a bearing 28, bearing shoe 30, bracket 32, bracket channel 34, and spring 36. More particularly, the bearing 28 includes an opening axially aligned with the pivot pin 26. Bearing 28 is attached to a bearing shoe 30, which is disposed in the channel 34 of bracket 32. Bearing shoe 30 may be formed of keystock or another suitably rugged material. Channel 34 is an elongated opening within bracket 32 in which the bearing shoe 30 may move. A dust shield 37 may be placed over the channel in order to reduce clogging. Bracket 32 may be approximately one inch by twelve inches and formed of a metal such as steel, or other suitable material. A spring 36 also is disposed in channel 34 and acts upon bearing shoe 30. The bearing 28 and bearing shoe 30 combination is biased by spring 36 toward the general direction of the mixing drum 110. The bracket assembly 31 may be mounted to the hopper support brace 122 or other appropriate structure of the concrete truck 100, so that plate 22 may be adjusted to a close position adjacent the rim 114 of mouth 112.

Figure 3:
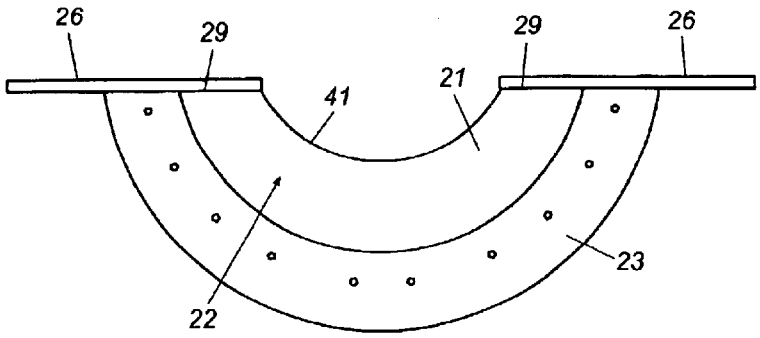
FIG. 3 is a front view of a plate and pivot pins of a mixing drum gate encompassing principles of the present invention.
Figure 4:
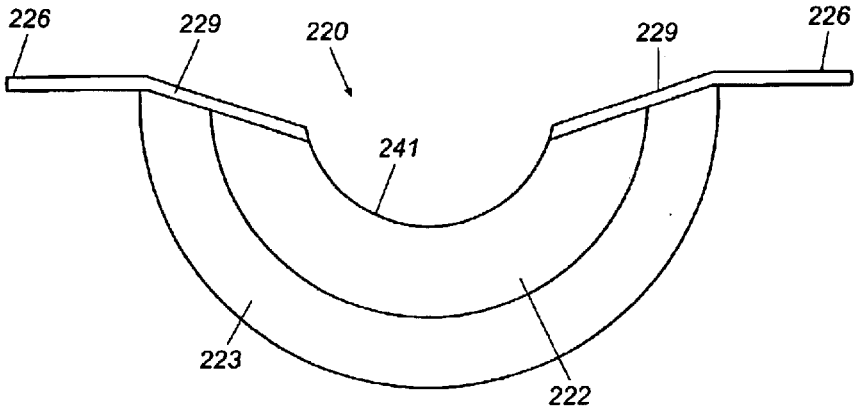
FIG. 4 is a front view of another embodiment of a plate and pivot pins of a mixing drum gate encompassing principles of the present invention.
Figure 5:
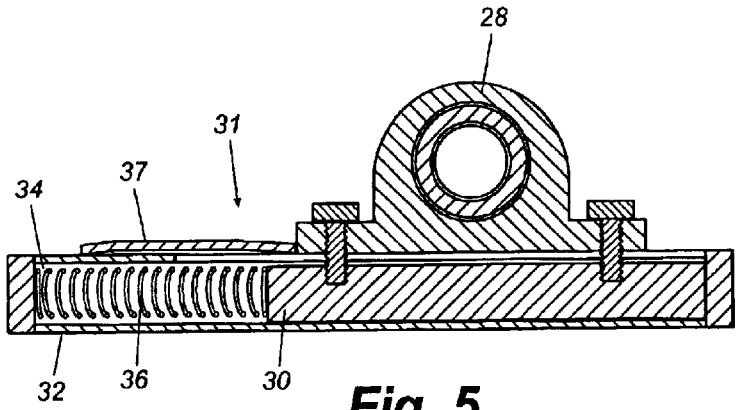
FIG. 5 is a cross-sectional view of a bracket assembly of a mixing drum gate encompassing principles of the present invention.
Figure 6:
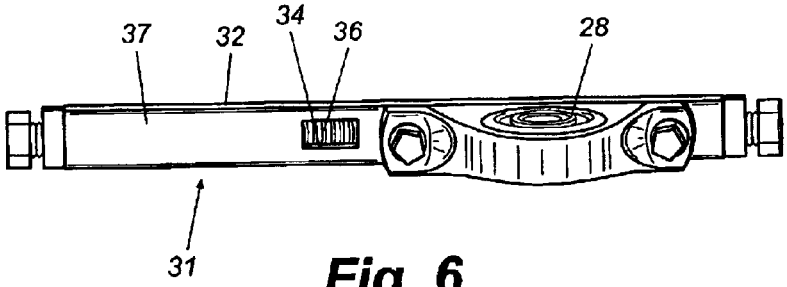
FIG. 6 is a top view of another embodiment of a bracket assembly of a mixing drum gate encompassing principles of the present invention.

A bib 23 may be attached to the inner face 21 of the plate 22, as shown in FIGS. 3 and 4. The bib 23 may be formed of an ultra high molecular weight plastic or other suitable material that will tend to provide sealing properties to the bib 23. The plastic material used to form bib 23 may be approximately 0.5 inches in thickness. The bib 23 contacts the rim 114 of the mouth 112 of the drum 110 so as to provide an improved contact or seal between the plate 22 and the rim 114.

Figure 7:
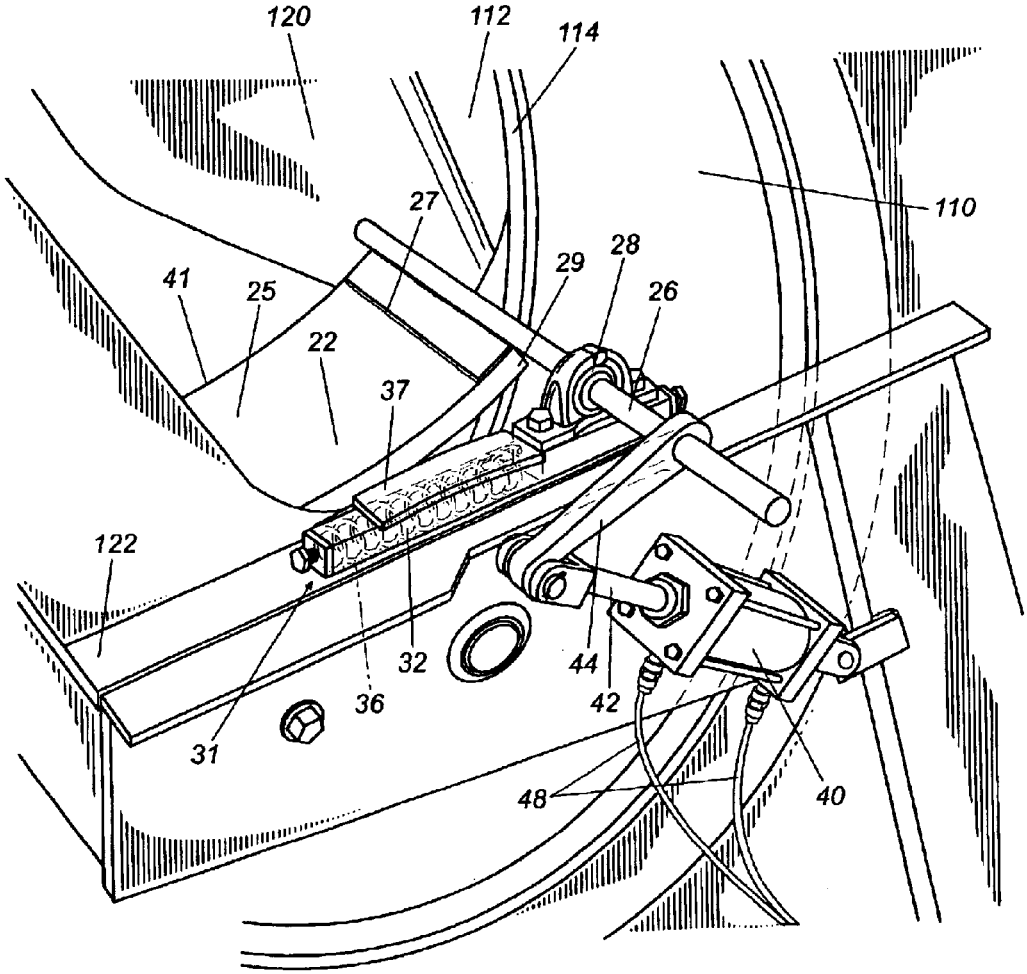
FIG. 7 is a perspective view of another embodiment of a mixing drum gate encompassing principles of the present invention.

An opening mechanism may also be operably connected to plate 22 so as to allow for the repositioning thereof. As shown in the figures, the opening mechanism may include a pneumatically controlled cylinder 40 having a movable piston 42 therein. In one embodiment, as shown in FIG. 7, the piston 42 is connected to the pivot pin 26 by an arm 44.

In another embodiment, shown in FIGS. 2 and 8, the piston 42 may be connected to the outer face 25 of plate 22 by an eyelet 47 and clevis pin or by an arm connecting the eyelet 47 to the piston 42. The eyelet 47 may be connected to the lower center portion of outer face 25 in order to facilitate the movement of plate 22. As shown in FIGS. 1 and 2, the cylinder 40 can be mounted to the hopper 120, in the case where it cooperates directly with plate 22 by connection with the outer face 25. Alternatively, as shown in FIG. 7, cylinder 40 can be mounted to the hopper support brace 122 when it cooperates with pivot pin 26 by the connection thereto by arm 44. These and other configurations of the cylinder placement are contemplated.

The cylinder 40 can be operated by a slide valve mounted in the cab of the truck 100 that is connected to the cylinder by line 48. A pressure switch is also provided that cooperates with the pneumatic cylinder system to indicate when gate 20 is open. The cylinder 40 also will be operably connected to an air regulator mounted on the closed side of cylinder 40. Speed valves may be mounted on the exhaust ports of slide valve. Emergency tees are also provided to operate the gate 20 manually in case the primary opening mechanism fails.

As shown in FIG. 4, another embodiment of the drum gate 220 of the present invention includes a plate 222 with pivot pins 226 and a plastic bib 223 attached thereto. The lower profile of the plate 222 is generally semicircular and includes a generally semicircular notch 241, as in the previous embodiment, but, unlike the previous embodiment, the shoulders 229 are sloped inwardly and down. These inwardly sloping shoulders 229 provide further clearance for concrete that is discharging from the mixing drum. The pivot pins 226 can be angled also so as to provide greater clearance when the gate 220 is open. This embodiment otherwise functions generally in the same manner as the embodiment of the plate shown in FIG. 3.

In use, concrete material is charged to the mixing drum 112 through the hopper 120, or other appropriate fashion. In the closed position, mixing drum gate 20 contacts the mixing drum 110. More specifically, in one embodiment, the plate 22 of the mixing drum gate 20 contacts or abuts the rim 114 of the mouth of the mixing drum 110. Even as the drum 110 rotates, the plate 22 contacts the rim 114. If a bib 23 is mounted on the inner surface 21 of plate 22 of the gate 20, then the bib 23 contacts and/or forms a seal with rim 114. This contact is sufficient to keep nearly all concrete material contained within the drum 110 from leaking between the rim 114 and the plate 22. The plate 22 obstructs the lower portion of the mouth 112, where concrete material is most likely to be spilling out of the mouth 112. As the concrete truck 100 and/or the mixing drum 10 moves and rotates, the drum 110 flexes and shifts, in addition to its rotation. As this movement occurs, the contact between the plate 20 and/or bib 23 and the rim 114 is maintained by the plate 22 being biased toward the mixing drum 10 and the rim 114. The biasing force is indirectly applied to the plate 22 by the spring 36, or other biasing means used with the gate 20, acting on the bearing shoe 30 located in the bracket channel 34 and connected to bearing 28. The bearing 28, in turn, biases the pivot pin 26 that is connected to plate 22 by lip 27. Thus, in this manner the gate 20 maintains the contact with the rim 114 and keeps concrete material from discharging from the mouth 112 of the drum 110.

Once the mixing drum 110 is ready to be discharged, the gate 20 can be opened. The operator can activate the slide valve located in the truck cab, thereby causing the cylinder piston 42 to retract and cause the plate 22 to pivot about the axis extending through the pivot pins 26 so as to move the lower portion of the plate 22 up and away from the rim 114. The concrete material contained within the mixing drum may then be discharged in the normal fashion. To close the gate 20, the slide valve can be reactivated to cause the cylinder piston 42 to extend and the plate 22 to pivot down.

It is to be understood that the above embodiments are provided by way of example only and are not to be construed so as to limit the present invention only to those aspects of the illustrated embodiments. The present invention encompasses modifications and alterations made to the disclosed embodiments by those of ordinary skill in the art.

What is claimed is:

1. A gate for a mixing drum having a mouth with a rim, said gate comprising:

a plate mounted adjacent the mouth of the mixing drum, said plate being movable between an open position displaced from the rim of the mouth and a closed position against the rim of the mouth, and a biasing member configured to bias said plate against the rim of the mouth of the mixing drum as the mixing drum rotates when said plate is in the closed position, wherein said biasing member comprises a spring operably connected to said plate, said spring biasing said plate toward said the mouth of the mixing drum when said plate is in the closed position; and a mounting bracket to which said plate is pivotally connected and wherein said spring is disposed within said mounting bracket.

2. The closure of claim 1, wherein said plate is semi-circular.

3. The closure of claim 2, wherein said plate is formed with an inwardly sloping shoulder.

4. The closure of claim 1, further comprising a bib attached to said plate, wherein said bib contacts a portion of the drum when said plate is in the closed position.

5. The closure of claim 1, further comprising a pneumatically-controlled piston operably connected to said plate for selectively moving said plate between the open position and the closed position.

6. A gate for a mixing drum having a mouth, said gate comprising:

a plate positioned adjacent to the mouth of the mixing drum;

a mounting bracket pivotally mounting said plate in position;

a spring operably connected to said plate, said spring biasing said plate toward the mouth of the mixing drum; and an opening mechanism operably connected to said plate and including a pneumatically-controlled piston, wherein said opening mechanism controllably moves said plate toward and away from the mouth of the mixing drum.

7. The gate of claim 6, wherein said plate is semi-circular.

8. The gate of claim 7, wherein said plate includes an inwardly sloping shoulder.

9. The gate of claim 6, further comprising a bib attached to said plate.

10. A gate for a mixing drum of a concrete transport vehicle comprising:

a plate pivotally connected to a mounting bracket by a pivot pin, said mounting bracket comprising a movable bearing operably connected to said pivot pin;

a spring operably connected to said plate, wherein said spring biases said plate toward the mixing drum;

a pneumatically-controlled opening mechanism operably connected to said plate.

11. The gate of claim 10, wherein said pneumatically-controlled opening mechanism is connected to said plate by an arm cooperating with an eyelet connected to said plate.

12. The gate of claim 10, further comprising a bib attached to said plate, wherein said bib contacts the rim of the mouth of the mixing drum when said plate is in the closed position.

13. The gate of claim 10, wherein said plate includes an inwardly sloping shoulder.

14. The gate of claim 10, wherein said plate is semi-circular.

15. A gate for a mixing drum of a concrete transport vehicle comprising:

a plate pivotally connected to a mounting bracket by a pivot pin, said mounting bracket comprising a movable bearing operably connected to said pivot pin; and a spring operably connected to said plate, wherein said spring biases said plate toward the mixing drum and wherein said spring is disposed within said mounting bracket.

16. A gate for a mixing drum having a mouth, said gate comprising:

a plate positioned adjacent to the mouth of the mixing drum;

a first mounting bracket located on one side of said plate;

a second mounting bracket located on an opposite side of said plate;

at least one pivot pin pivotally mounted in at least one of said brackets, wherein said at least one pivot pin pivotally supports said plate and is axially translatable along its bracket;

a first biasing member that exerts a force on said at least one pivot pin to bias said plate toward the mouth of the mixing drum when said plate is in a closed position; and an opening mechanism operably coupled to said plate.

17. The gate of claim 16, wherein said first biasing member comprises a spring.

18. The gate of claim 16, further comprising a second biasing member that exerts a force on said at least one pivot pin to bias said plate toward the mouth of the mixing drum.

19. A gate for a mixing drum having a mouth, said gate comprising:

a plate positioned adjacent to the mouth of the mixing drum and mounted on at least one pivotally supported pivot pin;

a first biasing member operably coupled to said at least one pivot pin, wherein said first biasing member exerts an axial force on said at least one pivot pin to bias said plate toward the mouth of the mixing drum as the mixing drum rotates when said plate is in a closed position; and an opening mechanism operably coupled to said plate, wherein said opening mechanism controllably moves said plate toward and away from the mouth of the mixing drum.

20. The gate of claim 19, further comprising a second biasing member operably coupled to said at least one pivot pin, wherein said second biasing member exerts an axial force on said at least one pivot pin to bias said plate toward the mouth of the mixing drum.

21. The gate of claim 20, wherein said at least one pivot pin comprises two pivot pins.

22. The gate of claim 21, comprising two bracket assemblies, wherein said plate is located between said bracket assemblies and each bracket assembly pivotally supports one of said pivot pins.

23. The gate of claim 22, wherein said first biasing member is axially translatable along its supporting bracket assembly.

24. The gate of claim 19, wherein said opening mechanism is pneumatic.

25. The gate of claim 24, wherein said first biasing member comprises a spring.

26. The gate of claim 19, wherein said at least one pivot pin comprises two pivot pins, said gate further comprising two bracket assemblies, wherein said plate is located between said bracket assemblies and each bracket assembly pivotally supports one of said pivot pins.

* * * * *